US007086115B1

(12) United States Patent
Rex et al.

(10) Patent No.: US 7,086,115 B1
(45) Date of Patent: Aug. 8, 2006

(54) BATTERY-OPERATED HAND HELD DUSTER

(76) Inventors: Suzzy Rex, 15241 E. 400 Rd., Claremore, OK (US) 74017; Brandi Sislo, 15241 E. 400 Rd., Claremore, OK (US) 74017

( * ) Notice: Subject to any disclaimer, the term of this patent is extended or adjusted under 35 U.S.C. 154(b) by 0 days.

(21) Appl. No.: 10/799,894

(22) Filed: Mar. 15, 2004

(51) Int. Cl.
*A46B 5/02* (2006.01)

(52) U.S. Cl. ..... 15/144.1; 15/145; 15/144.3; 15/22.1; 16/427

(58) Field of Classification Search ..... 15/22.1, 15/23, 28, 144.1, 144.3–144.4, 145, 97.1, 15/414, 410, 415.1, 327.1, 327.3–327.7, 15/377; 16/429, 427, 436
See application file for complete search history.

(56) References Cited

U.S. PATENT DOCUMENTS

| | | | | | |
|---|---|---|---|---|---|
| 2,624,061 | A * | 1/1953 | Leas | 15/144.4 |
| 2,753,579 | A * | 7/1956 | Kussmann | 15/145 |
| 3,423,781 | A * | 1/1969 | Henson | 15/145 |
| 4,137,588 | A * | 2/1979 | Sandt et al. | 15/22.1 |
| 4,204,292 | A * | 5/1980 | Lester et al. | 15/28 |
| D259,618 | S | 6/1981 | Tack | |
| 4,748,712 | A | 6/1988 | DiGiovanni | |
| 4,956,892 | A | 9/1990 | Fawkes | |
| 5,290,082 | A | 3/1994 | Palmer et al. | |
| 5,338,128 | A * | 8/1994 | Blanco | 403/206 |
| 5,500,972 | A * | 3/1996 | Foster | 15/28 |
| 5,609,255 | A * | 3/1997 | Nichols | 206/576 |
| 5,791,006 | A * | 8/1998 | Anctil | 15/144.4 |
| 5,794,303 | A | 8/1998 | San Filippo et al. | |
| 5,970,572 | A | 10/1999 | Thomas | |
| 6,295,681 | B1 * | 10/2001 | Dolah | 15/22.1 |
| 6,360,399 | B1 | 3/2002 | Vandenbelt et al. | |
| 6,493,903 | B1 | 12/2002 | Super | |
| 2003/0097724 | A1 * | 5/2003 | Park | 15/23 |
| 2004/0261204 | A1 * | 12/2004 | Pears et al. | 15/28 |

* cited by examiner

*Primary Examiner*—Gladys J. P. Corcoran
*Assistant Examiner*—Shay Balsis
(74) *Attorney, Agent, or Firm*—John D. Gugliotta

(57) ABSTRACT

A cordless hand held duster comprising a handle and a small feather duster head attachable thereto. An internal battery and motor provides power to rotate or vibrate the duster head for removing dust and debris. The duster head can attach directly to the tool for dusting tables or other low surfaces, or various extension arms can be used, including a straight arm or variously angled arms. One extension arm, or a combination of extension arms, may be used to accommodate removal of dust, dirt or debris from elevated spaces, recesses or objects.

1 Claim, 3 Drawing Sheets

BATTERY-OPERATED HAND HELD DUSTER

RELATED APPLICATIONS

The present invention contains subject matter that was first described in Disclosure Document Registration 526,853 filed on Jan. 29, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to a battery-powered, hand-held duster and, more particularly, to a cordless, hand-held duster comprising a spinning or rotating head having bristles of a soft, fine, and delicate texture for picking up particles, and interchangeable handle extensions being available in a variety of lengths and shapes.

2. Description of the Related Art

As is well known in the art, with today's fast-paced lifestyles, people are becoming increasingly pressed to accomplish the variety of household chores under their responsibility. Accordingly, there are a seemingly endless number of cleaning products that help perform a broad array of these tasks in an efficient and effective manner. There exists a product, whether a tool, device or cleaning solution, that will make virtually every job easier, no matter how large or small it may be. This fact is obvious to anyone who visits a store and views the vast array of products and chemicals to help keep bathrooms clean. However, there are very few products to help with perhaps the most common cleaning task of all—dusting. There are sprays and treated clothes, which help, but a feather duster is still most commonly used to dust intricate objects and flat surfaces. However, many of these areas are elevated and only can be reached while standing on a stool, thus compromising one's safety. Additionally, the back and forth action required by one's wrist quickly becomes tiring.

A search of the prior art did not disclose any patents that read directly on the claims of the instant invention; however, the following references were considered related:

| U.S. Pat. No. | Description/Title |
|---|---|
| 6,493,903 | Hand-held vacuum cleaner with headlamp |
| 6,360,399 | Hand-held vacuum cleaner with interchangeable control panel module |
| 5,970,572 | Battery-operated hand vacuum cleaner with liquid spray |
| 5,794,303 | Hand held vacuum and scraper combination |
| D 259,618 | Hand-held vacuum cleaner with light |
| 5,290,082 | Battery operated hand held vacuum handling device |
| 4,956,892 | Cordless vacuum brush |
| 4,748,712 | Cobweb vacuum cleaner |

Consequently, there is a need for a means by which objects and surfaces can easily be dusted without the disadvantages as listed above.

SUMMARY OF THE INVENTION

It is therefore an object of the present invention to provide an improved battery-powered, hand-held duster.

It is a feature of the present invention to provide an improved cordless, hand-held duster comprising a rotatable head having bristles of a soft, fine, and delicate texture for picking up particles, and interchangeable handle extensions being available in a variety of lengths and shapes Briefly described according to one embodiment of the present invention, a battery-operated hand held duster is provided as an apparatus that aids in dusting objects and surfaces. The invention resembles a tool the size of an electric toothbrush, but in lieu of a toothbrush head, a small feather duster is provided. An internal battery and motor provides power to rotate or vibrate the duster head to aid in dusting duties, and relieve the user from moving their wrist. The duster head can attach directly to the tool for dusting tables or other low surfaces, or various extension arms can be used. A straight arm is useful for reaching high spaces or cobwebs along the ceilings. An angled arm is useful for reaching high shelves or similar spaces. An inverted "U"-shaped head is useful for the tops of doorways or doors. Such extension arms can be used in combination and eliminate the need to stretch, overreach or stand on a stool when dusting.

The use of the Battery-Operated Hand Held Duster allows homeowners and professional cleaning staff the ability to quickly and easily dust almost any surface, no matter the height, while reducing stress and strain on one's arm and hand muscles.

In accordance with a preferred embodiment, the present invention aids in the dusting of objects and horizontal surface.

Additionally, an advantage of the present invention is that it eliminates reaching and stretching during dusting operations.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
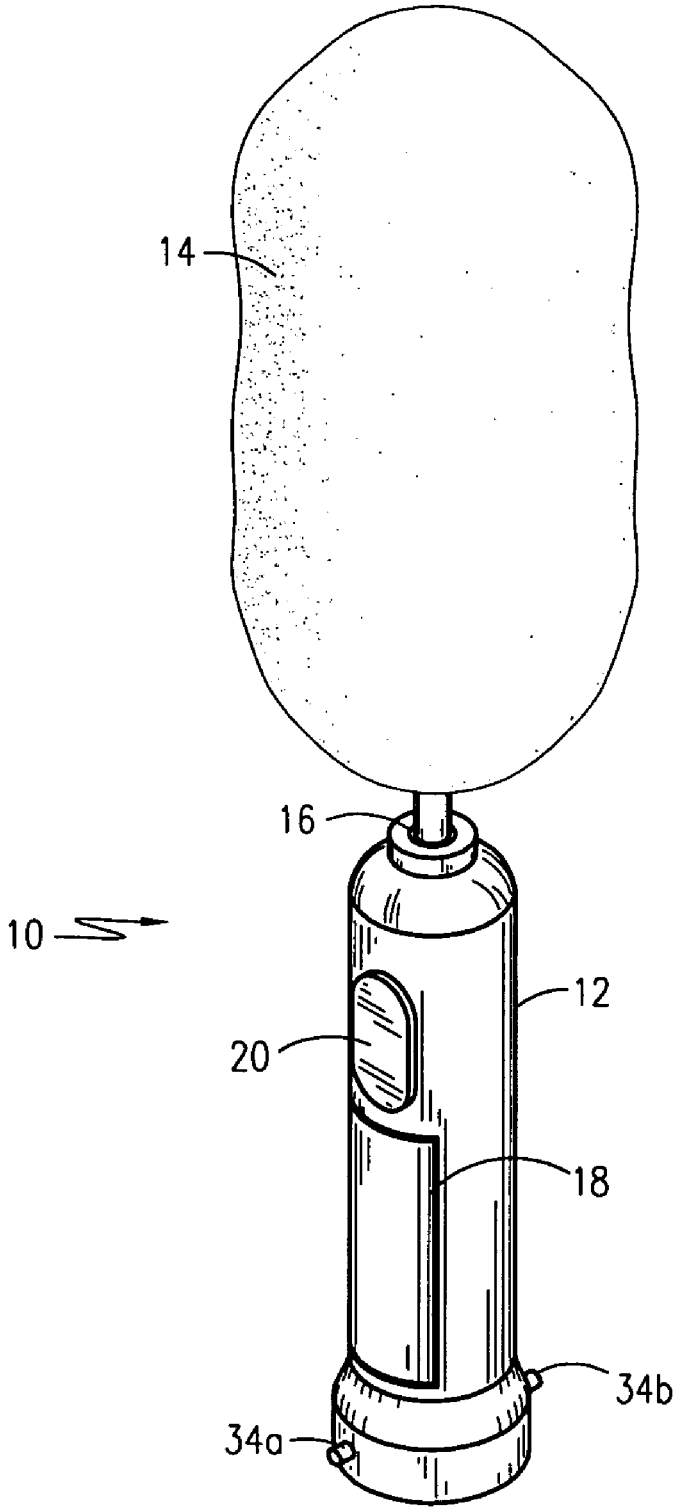
FIG. 1 is a perspective view of a battery-operated hand held duster 10 according to the preferred embodiment of the present invention.
Figure 2:
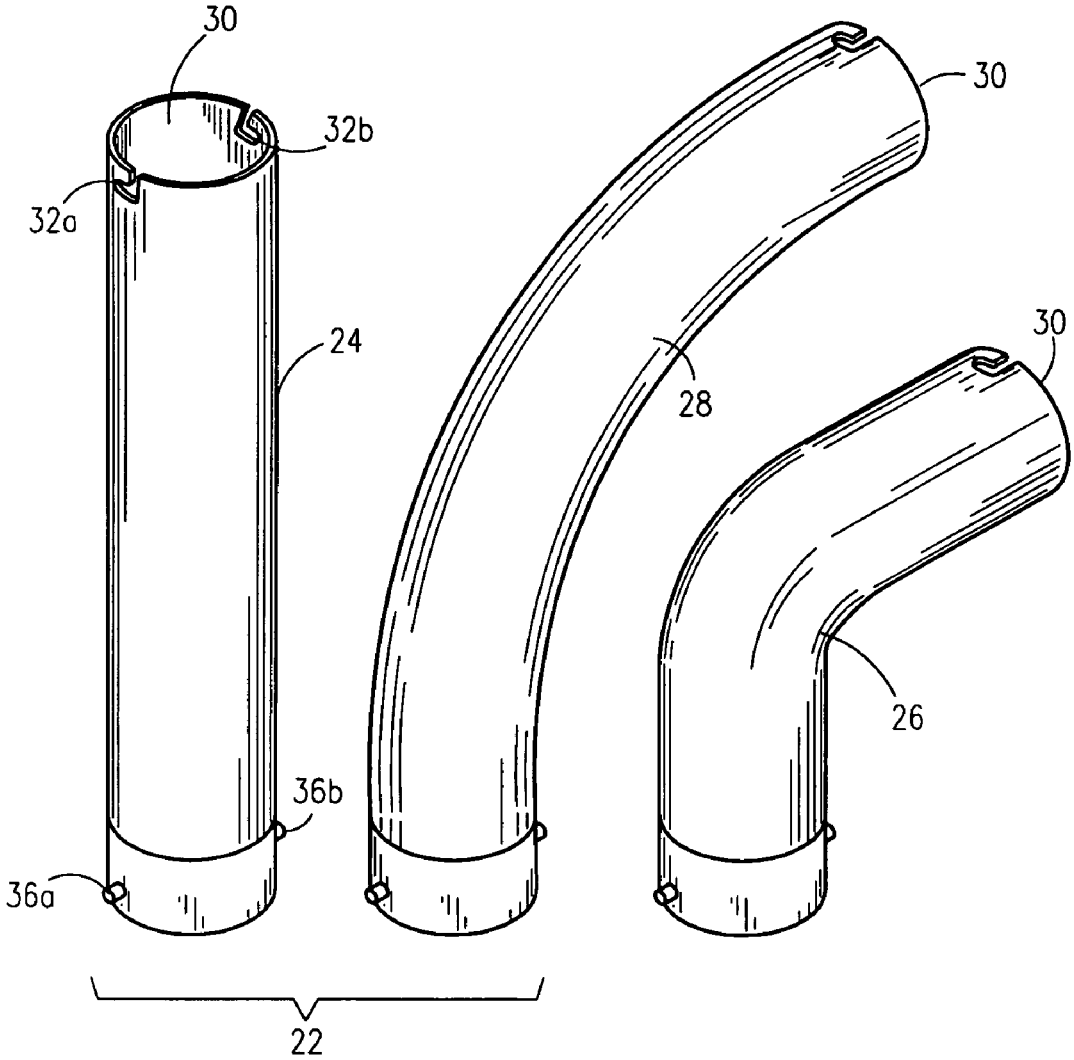
FIG. 2 is a perspective view of duster head extensions 22 for detachable and interconnecting use therewith.
Figure 3:
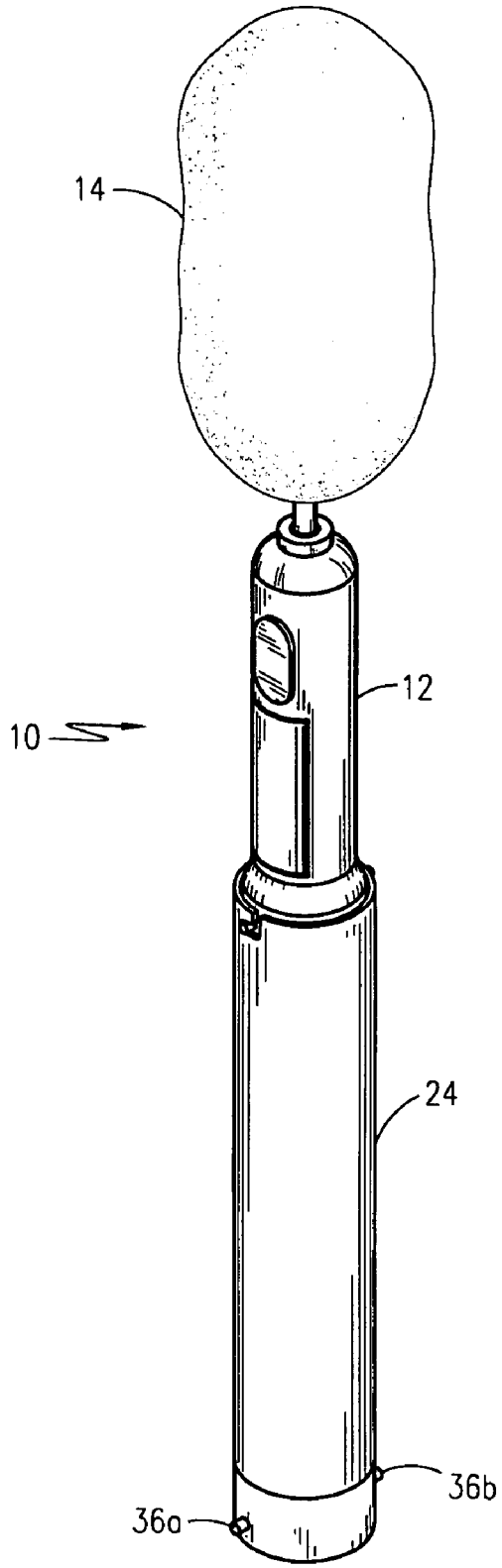
FIG. 3 is a perspective view of the present invention shown assembled with said duster head extensions 22.

The best mode for carrying out the invention is presented in terms of its preferred embodiment, herein depicted within the FIGS. 1–3.

1. Detailed Description of the Figures

Referring now to FIGS. 1–2, a battery-operated or cordless hand held duster 10 is shown, according to the present invention, for aiding in dusting objects and surfaces. The duster 10 includes a handle 12 of a size and shape to fit into the palm of a user's hand, and a feather duster head 14 removably affixed or attached to a distal end of the handle 12 at a detachable head connection 16. An internal battery and motor are housed within an internal compartment 18 and are in electrical communication with controls 20 to allow actuating power for rotating or vibrating the duster head 14 to aid in dusting duties, and relieve the user from moving their wrist. As shown in conjunction with FIG. 3, the duster head 14 can attach directly to the tool for dusting tables or other low surfaces, or various duster head extensions 22 can be used for reaching elevations beyond the bounds of the duster 10. Although it is anticipated that various configurations of duster head extensions 22 can be provided, shown are a straight extension arm 24, anticipated as being useful for reaching high spaces or cobwebs along the ceilings. An angled extension arm 26 is useful for reaching high shelves or similar spaces. A curved extension arm 28 can be used in conjunction with the angled extension arm 26 to form an inverted "U"-shaped head is useful for the tops of doorways or doors.

To affix in a detachable and interchangeable fashion, each extension arm 24, 26 and 28 includes a cylindrical receiving cavity 30 and a pair of opposing receiving slots 32*a* and 32*b*, the cavity 30 formed at the distal end of the arm 24, 26 and 28 in which the slots 32*a* and 32*b* are formed. The cavity 30 is provided so as to circumscribe the proximal end of the handle 12. The receiving slots 32*a* and 32*b* are shown as L-shaped slots (although other configurations are envisioned) and provided for receiving guide locking pins 34*a* and 34*b* formed at the proximal end of the handle 12, the pins 34*a* and 34*b* provided along the external or outer circumferential surface approximately 180° apart (or diametrically opposed). The pins 34*a* and 34*b* are aligned with and slid into the corresponding receiving slots 32*a* and 32*b*. In the L-shaped slots 32*a* and 32*b* depicted by the figures, the pins 34*a* and 34*b* are inserted into the longer, vertical portion of the slots 32*a* or 32*b* and then rotated so as to insert into the shorter, horizontal portion of the slots 32*a* or 32*b*, thereby providing impingement of the pins 34*a* or 34*b* therein. It is intended that the longer, vertical portions of the slots 32*a* and 32*b* are aligned and the shorter, horizontal portions are also aligned, the alignment approximately 180° apart (or diametrically opposed) along the circumference of the arms 24, 26 and 28.

Similarly, the proximal end of each duster head extension arms 24, 26 and 28 has an equivalent pair of protruding guide locking pins 36*a* and 36*b* that, in conjunction with the receiving slots 32*a* and 32*b*, form a modular attachment means that allow a cylindrical receiving cavity 30 to receive and circumscribe the proximal end of another duster head extension arms 24, 26 and 28, wherein the guide locking pins 36*a* and 36*b* are aligned with and slide into the corresponding receiving slots 32*a* and 32*b*.

Such extension arms can be used in combination and eliminate the need to stretch, overreach or stand on a stool when dusting.

2. Operation of the Preferred Embodiment

In operation, the present invention's duster head can attach directly to the tool for dusting tables or other low surfaces, or various extension arms can be used. A straight arm is useful for reaching high spaces or cobwebs along the ceilings. An angled arm is useful for reaching high shelves or similar spaces. An inverted "U"-shaped head is useful for the tops of doorways or doors. Such extension arms can be used in combination and eliminate the need to stretch, overreach or stand on a stool when dusting.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, thereby enabling others skilled in the art to best utilize the invention. It is intended that the scope of the invention be defined by the Claims appended hereto and their equivalents. Therefore, the scope of the invention is to be limited only by the following claims.

What is claimed is:

1. A cleaning apparatus comprising:

a handle having:

an operational control;

a pair of pins formed at a proximal end of said handle;

an internal compartment housing a power source and motor, said power source and motor electrically coupled to said operational control;

a cleaning head removably attached to a distal end of said handle;

a first extension arm, a second extension arm, and a third extension arm, wherein each one of said arms comprises:

a cavity formed at a distal end of said arm, said cavity receiving said proximal end of said handle;

a pair of slots formed circumjacent said cavity, each one of said slots receiving and coupling with each one of said pins;

wherein one of said arms is a curvilinear extension arm and one of said arms is an angled extension arm, said curvilinear extension arm is coupled to said angled extension arm;

wherein one of said curvilinear extension arm and said angled extension arm is coupled to said handle, wherein said handle, said curvilinear extension and said angled extension arm form a U-shape for reaching elevated and recessed areas.

* * * * *